US005469102A

United States Patent [19]

Shou et al.

[11] Patent Number: 5,469,102

[45] Date of Patent: Nov. 21, 1995

[54] CAPACITIVE COUPLED SUMMING CIRCUIT WITH SIGNED OUTPUT

[75] Inventors: Guoliang Shou; Weikang Yang; Sunao Takatori; Makoto Yamamoto, all of Tokyo, Japan

[73] Assignee: Yozan Inc., Tokyo, Japan

[21] Appl. No.: 196,837

[22] Filed: Feb. 15, 1994

[30] Foreign Application Priority Data

Feb. 16, 1993 [JP] Japan ..... 5-051502

[51] Int. Cl.[6] ..... G06G 7/42

[52] U.S. Cl. ..... 327/361

[58] Field of Search ..... 327/336, 337, 327/345, 339, 355, 361, 554

[56] References Cited

U.S. PATENT DOCUMENTS

| | | | |
|---|---|---|---|
| 3,921,080 | 11/1975 | Hardy | 328/133 |
| 3,970,774 | 7/1976 | Bazin et al. | 178/6 |
| 4,835,482 | 5/1989 | Tamakoshi et al. | 328/167 |
| 4,903,226 | 2/1990 | Tsividis | 364/807 |

FOREIGN PATENT DOCUMENTS

WO8900739 1/1989 WIPO .

OTHER PUBLICATIONS

Patent Abstracts of Japan, vol. 4, No. 67 (E–100) 20 May 1980 & JP–A–55 034 593; English abstract.

Patent Abstracts of Japan, vol. 13, No. 201 (E–757) 12 May 1989 & JP–A–01 020 788; English abstract.

Derwent Abstract—Soviet Inventions Illustrated, Section EQ, Week 8548, 23 May 1985, AN 85–301827 & SU–A–1 157 677 (May 1985).

*Primary Examiner*—Timothy P. Callahan
*Assistant Examiner*—Jeffrey Zweizig
*Attorney, Agent, or Firm*—Cushman, Darby & Cushman

[57] ABSTRACT

A summing circuit for executing summing of analog data with sign. The summing circuit includes two serially connected inverters INV1 and INV2, each having a feed back line, and selectively inputs data D1 to D8 to one of the first or the second stages, corresponding to positive/negative sign signals S1 to S8.

3 Claims, 2 Drawing Sheets

CAPACITIVE COUPLED SUMMING CIRCUIT WITH SIGNED OUTPUT

FIELD OF THE INVENTION

The present invention relates to a summing circuit.

BACKGROUND OF THE INVENTION

In recent years, concerns have arisen about limitations of digital computers due to the expotential increase in the cost of fine processing technology. It is known to provide a weighted summing by a capacitive coupling in which a plurality of capacitances are connected in parallel; however, a circuit for summing data and providing a signed output has not been known.

SUMMARY OF THE INVENTION

The present invention solves the conventional problems and provides a summing circuit for summing analog data with sign.

A summing circuit according to the present invention guarantees output accuracy by a composition of two serially connected inverters, each of which includes a feed back line. Data is selectively input to one of the first or the second inverter stages, in response to a sign signal or positive/negative signal.

PREFERRED EMBODIMENT OF THE PRESENT INVENTION

Hereinafter, a preferred embodiment of the present invention is described with reference to the attached drawings.

Figure 1:
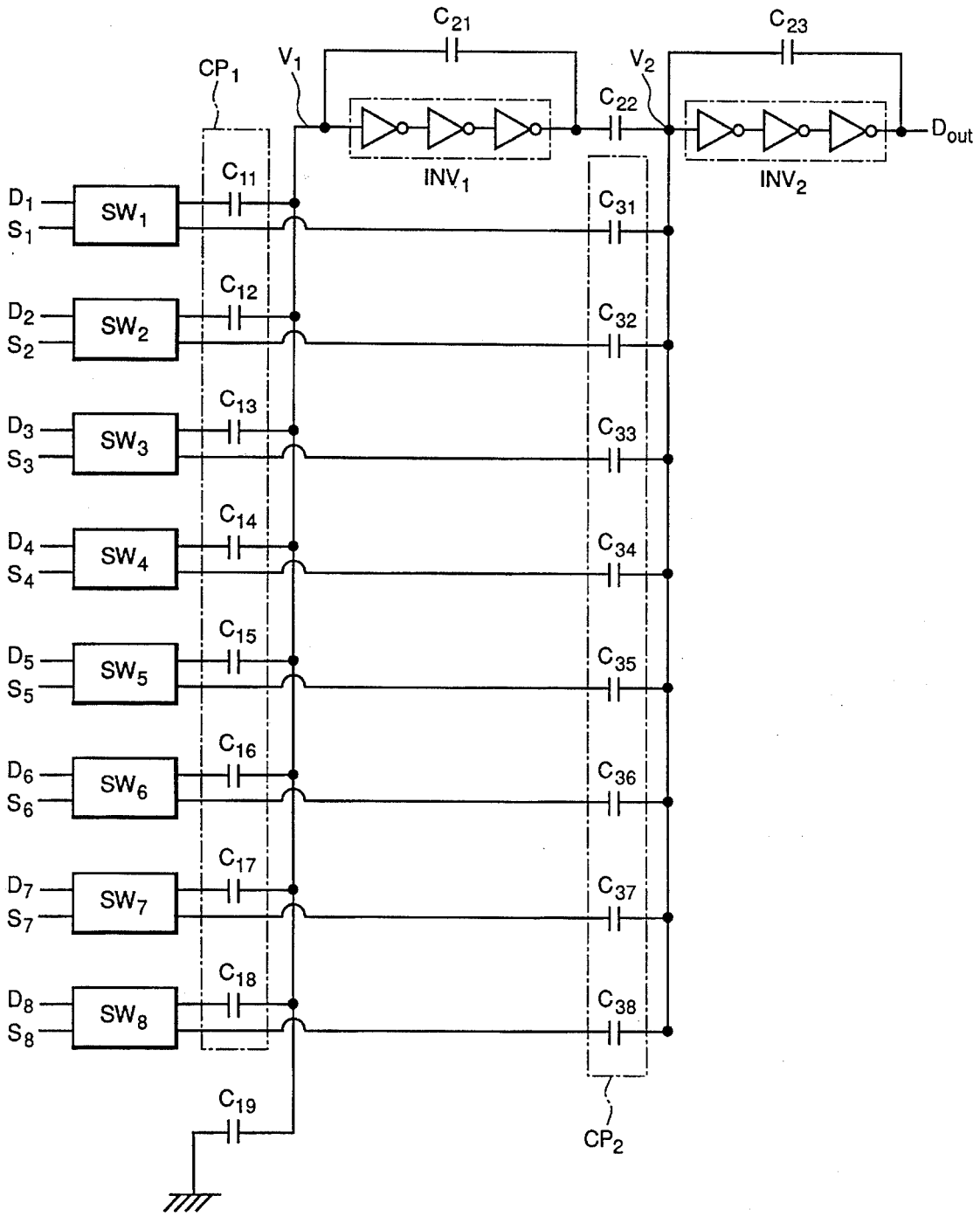
FIG. 1 is a circuit diagram showing an embodiment of the present invention.

In FIG. 1, a summing circuit comprises two serially connected inverters INV1 and INV2, with the output of INV1 connected with the input of INV2 through capacitance C22. The output of INV1 is fed back to its input through capacitance C21, and the output of INV2 is fed back to its input through capacitance C23. INV1 and INV2 have good accuracy and linear characteristics due to their large gain and feed back lines.

Capacitive coupling CP1 includes a plurality of capacitances C11 to C18 connected in parallel to the input of INV1 and capacitive coupling CP2 includes a plurality of capacitances C31 to C38 connected in parallel to the input of INV2. Capacitances C1i and C3i, corresponding to capacitive couplings CP1 and CP2, are each connected to the output of a corresponding common switching means SWi. Each switch SWi is supplied with an input voltage Di and a corresponding sign signal Si indicating the plus/minus state of the input voltage. The voltage level of Di is positive and represents the absolute value of the input data.

Switching means SWi is responsive to sign signal Si, and Di is input to INV1 via CP1 when the corresponding sign signal is positive. When the corresponding sign signal is negative, Di is input to INV2 via CP2. SWi connects nonselected capacitances C1i or C3i to ground. Here, Si has a binary value of 0 or 1. When Di is positive, Si is equal to 0. When Di is negative, Si is equal to 1. Input voltages V1 and V2 corresponding to INV1 and INV2 are calculated as below.

Formula 1

$$V1 = -\sum_{i=1}^{8} DiSiC1i/CT1$$

$$CT1 = \sum_{i=1}^{9} C1i$$

$$V2 = \sum_{i=1}^{8} \{DiSiC3i - C22V1(CT1/C21)\}/CT2$$

$$CT2 = \sum_{i=1}^{9} C3i + C22$$

Then following conditions are set, and Formula 2 is obtained.

C19=C21=C22=C23=16C11 and C1i=C3i=constant.

Formula 2

$$V2 = \left( -\sum_{i=1}^{8} DiSiC1i + \sum_{i=1}^{-8} DiSiC3i \right)/24$$

Output Dout of INV2 is calculated as Formula 3.

Formula 3

$$\begin{aligned} Dout &= -(Ct2/C23)V2 \\ &= \left( \sum_{i=1}^{8} DiSi - \sum_{i=1}^{-8} DiSi \right)/16 \end{aligned}$$

It shows a regulated summing result with signals.

Figure 2A:
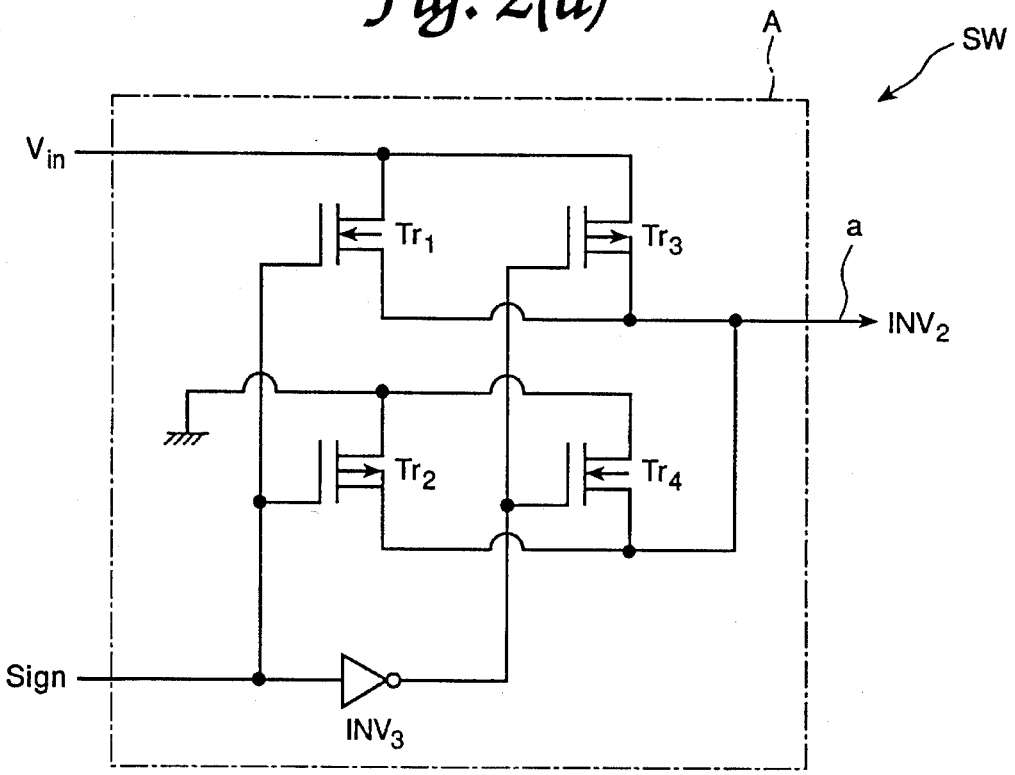
FIGS. 2(*a*) and 2(*b*) are circuits showing switching.
Figure 2B:
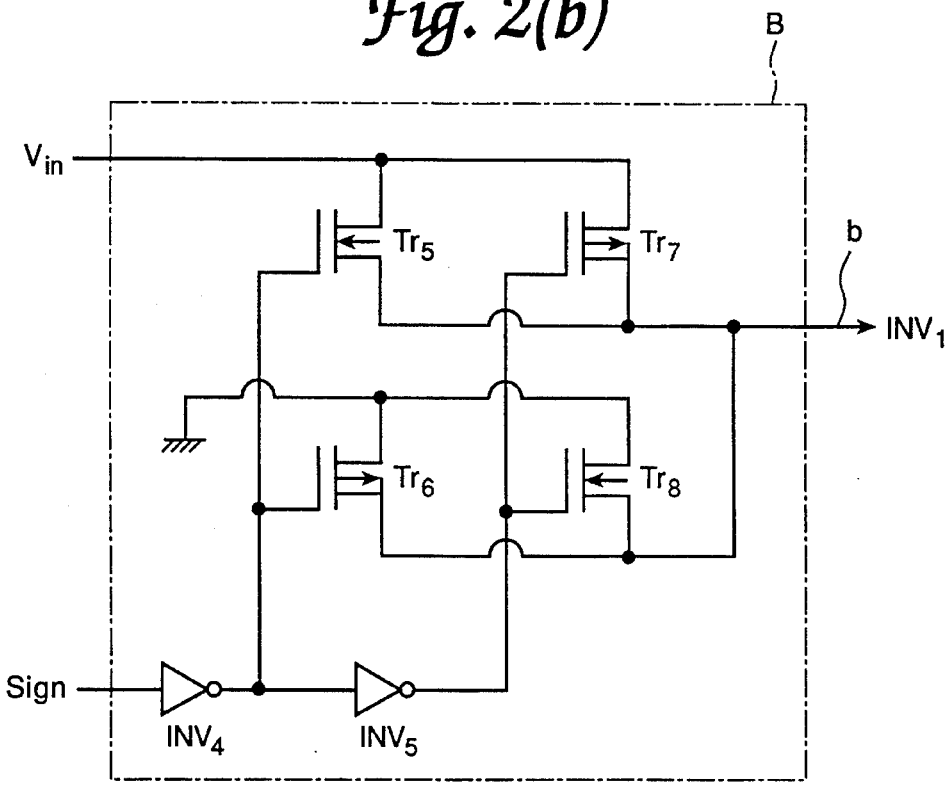

FIGS. 2(*a*) and 2(*b*) are circuits of switching means SW and includes toggle portion A in FIG. 2(*a*) and toggle portion B in FIG. 2(*b*).

Toggle portion A consists of transistors Tr1 to Tr4 and INV3. Voltage Vin is input to the drains of Tr1 and Tr3. Sources of Tr1 and Tr3 are connected with output terminal a. Sign signal Sign is input to the gate of Tr1 and, through INV3, to the gate of Tr3. The sources of Tr2 and Tr4 are grounded, and the drains of Tr2 and Tr4 are connected to output terminal a. Sign signal Sign is input to the gate of Tr2 and, through INV3, to the gate of Tr4.

The toggle portion B consists of transistors Tr5 and Tr8, INV4 and INV5 in a similar circuit to the toggle portion A. At the drains of Tr5 and Tr7, voltage Vin is input and the sources of Tr5 and Tr7 are connected to output terminal b. At the gate of Tr5, sign signal Sign is input through INV4. At the gate of Tr7, sign signal Sign is input through INV4 and INV5. The sources of Tr6 and Tr8 are grounded and the drains of Tr6 and Tr8 are connected to output terminal b. At the gate of Tr6, sign signal Sign is input through INV4, and at the gate of Tr8, sign signal Sign is input through INV4 and INV5.

When sign signal Sign is "1", then Tr1 and Tr3 of toggle part A are conductive. Then voltage Vin is input to output terminal a and input to INV2. On the other hand, at toggle part B, Tr6 and Tr8 are conductive and output terminal b is grounded and becomes voltage OV.

On the other hand, when sign signal Sign is "0", the output terminal of toggle part A is grounded and becomes OV, Vin is input to output terminal b of toggle part B, and Vin is input to INV1.

A summing circuit according to the present invention guarantees output accuracy by two serially connected inverters including feed back lines and selectively inputs data to one of the first or the second inverter stages, in response to a positive/negative signal so as to provide a summing circuit for summing analog data with a sign.

What is claimed is:

1. A summing circuit comprising:

a plurality of input terminals, each receiving an input voltage;

a first capacitive coupling having a first plurality of capacitances corresponding to said plurality of input terminals;

a second capacitive coupling having a second plurality of capacitances corresponding to said input terminals;

a plurality of switching means corresponding to said plurality of input terminals, each switching means connecting a corresponding one of said plurality of input terminals to a corresponding capacitance of said first capacitive coupling or said second capacitive coupling in response to a sign signal, said sign signal indicating whether the input voltage each received at each input has a positive value or a negative value, said switching means connecting said input terminal to a corresponding capacitance of said first capacitive coupling when said sign signal is positive and to a corresponding capacitance of said first capacitive coupling when said sign signal is positive and to a corresponding capacitance of said second capacitive coupling when said sign signal is negative;

a first linear amplifier having a first amplifier input and a first amplifier output, said first inverter input being connecting to an output of said first capacitive coupling;

a coupling capacitance connected to said first amplifier output; and a second linear amplifier having a second amplifier input and a second amplifier output, said second amplifier input connected to said coupling capacitance and to an output of said second capacitive coupling.

2. The summing circuit of claim 1, wherein each of said first plurality of capacitances and said second plurality of capacitances has the same value.

3. The summing circuit of claim 1, wherein each of said first linear amplifier and said second linear amplifier includes a plurality of inverters connected in series and a feedback capacitance connected between an output of a first one of said plurality of inverters and an input of a second one of said plurality of inverters.

* * * * *